United States Patent [19]

Lynch et al.

[11] Patent Number: 4,592,185

[45] Date of Patent: Jun. 3, 1986

[54] BUILDING PANEL

[75] Inventors: Steven K. Lynch, Elgin; Erland D. Narhi, Streamwood; Frank J. Walter, Aurora, all of Ill.

[73] Assignee: Masonite Corporation, Chicago, Ill.

[21] Appl. No.: 627,192

[22] Filed: Jul. 2, 1984

[51] Int. Cl.[4] ..... E04D 1/00

[52] U.S. Cl. ..... 52/543; 52/314; 52/555

[58] Field of Search ..... 52/543, 311–315, 52/553, 555, 309.8, 539, 533, 556

[56] References Cited

U.S. PATENT DOCUMENTS

| | | | |
|---|---|---|---|
| Re. 24,246 | 12/1956 | Fink et al. | 52/553 |
| 373,373 | 11/1887 | Montross . | |
| 2,264,546 | 12/1941 | Ochs . | |
| 3,333,384 | 8/1967 | Brady | 52/557 |
| 3,473,274 | 10/1969 | Godes | 52/543 X |
| 3,626,439 | 12/1971 | Kneisel | 52/533 |
| 3,643,394 | 2/1972 | Johnson | 52/309 |
| 3,702,031 | 3/1973 | Wilson et al. | 52/520 |
| 3,703,795 | 11/1972 | Mattes | 52/521 |
| 3,796,586 | 9/1971 | Hanlon et al. | 117/8 |
| 3,848,383 | 11/1974 | Wilson et al. | 52/533 |
| 3,848,384 | 11/1974 | Eaton et al. | 52/420 |
| 3,852,934 | 12/1974 | Kirkhuff | 52/539 |
| 3,868,300 | 2/1975 | Wheeler | 162/124 |
| 3,897,667 | 8/1975 | Turek | 52/546 |
| 3,899,855 | 8/1975 | Gadsby | 52/90 |
| 3,927,501 | 12/1975 | Allen et al. | 52/555 |
| 3,943,677 | 3/1976 | Carothers | 52/309 |
| 4,015,391 | 4/1977 | Epstein | 52/543 X |
| 4,061,813 | 12/1977 | Geimer et al. | 428/183 |
| 4,065,899 | 1/1978 | Kirkhuff | 52/309.8 |
| 4,102,106 | 7/1978 | Golder et al. | 52/533 |
| 4,188,762 | 2/1980 | Tellman | 52/541 |
| 4,261,152 | 4/1981 | Tellman | 52/541 |
| 4,266,382 | 5/1981 | Tellman | 52/316 |
| 4,279,106 | 7/1981 | Gleason et al. | 52/100 |
| 4,366,197 | 12/1982 | Hanlon et al. | 428/43 |
| 4,432,183 | 2/1984 | Pike et al. | 52/543 X |

*Primary Examiner*—J. Karl Bell

*Attorney, Agent, or Firm*—Mason, Kolehmainen, Rathburn & Wyss

[57] ABSTRACT

A building panel for surfacing exterior and interior wall and roof structures comprises an outer shell formed of relatively thin, molded hardboard material having upper and lower edges, opposite ends, a molded outer surface adapted for exposure to the weather and a back surface. The shell is formed with a cross-sectional profile extending transversely between the upper and lower edges comprising a lower edge portion extending upwardly and outwardly of the lower edge of the panel and a back plane of the panel joining an intermediate portion which is spaced outwardly of the back plane. A row of fastener receiving depressions is formed along an upper edge of the intermediate portion and these depressions have a base spaced inwardly of the surrounding surface with a back face of said depression bases lying substantially on said back plane. The profile further includes an upper edge portion above the row of fastener receiving depressions which terminates along the upper edge of the panel. The molded shell profile has an overall dimension between an outer face of the intermediate portion and said back plane that is substantially greater than the nominal wall thickness of the shell material between the outer and back surfaces thereof.

20 Claims, 18 Drawing Figures

FIG. 8
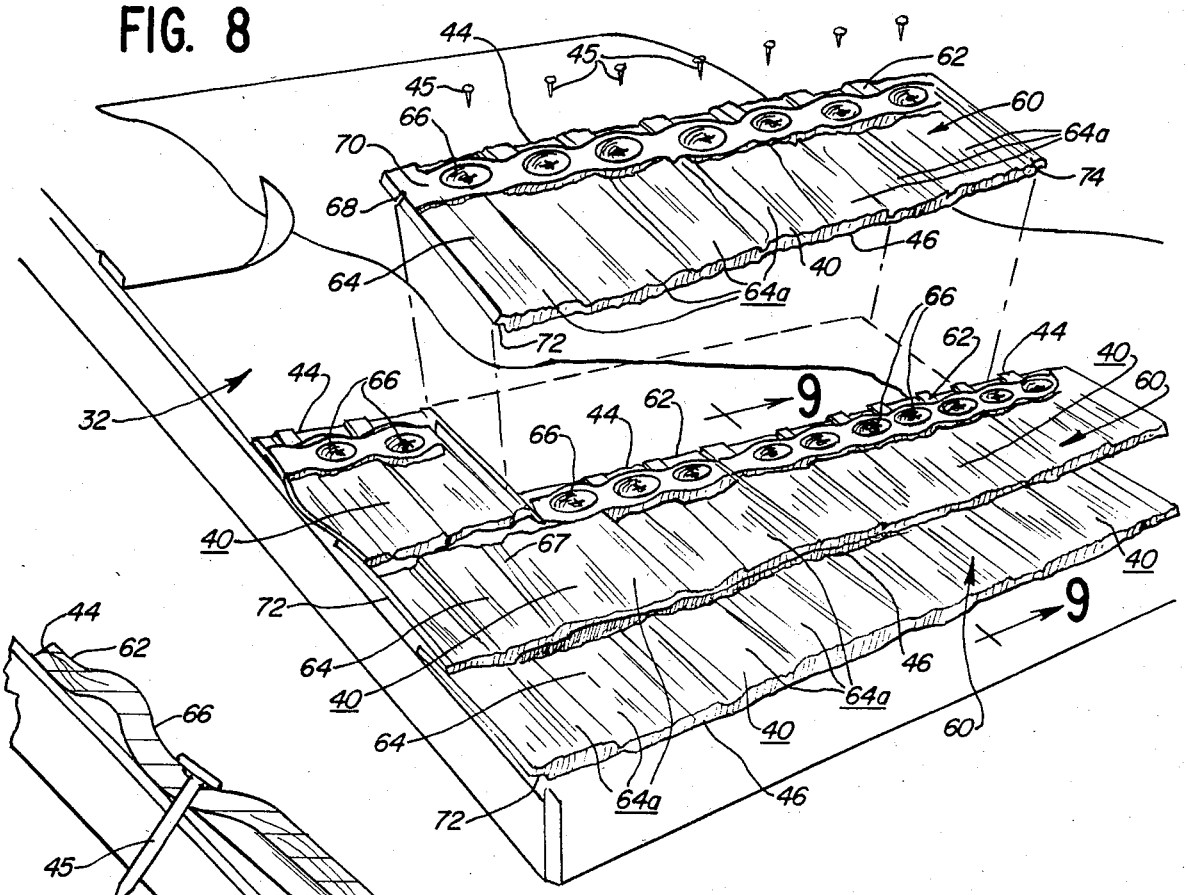
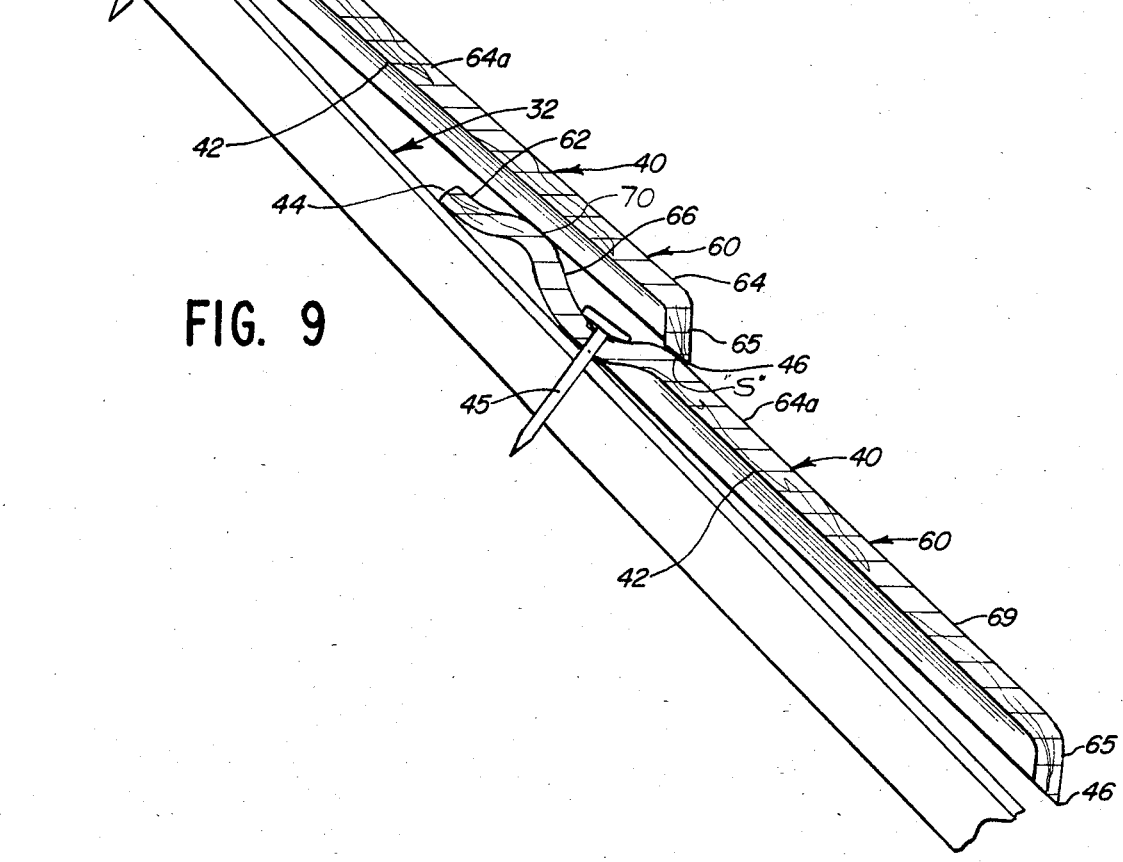
FIG. 9

BUILDING PANEL

BACKGROUND OF THE INVENTION

1. Field of the Invention

The present invention relates to building panels formed of thin-walled, molded hardboard and adapted to be used for interior and exterior roof and wall surfaces on a wide variety of building structures.

In accordance with the present invention it has been found that hardboard formed of composite wood fibrous material can be molded in both wet and dry processes into relatively intricate shapes and profiles to provide roofing and siding products that closely resemble real wood and lumber yet requiring much lower quantities of wood materials for manufacture and consequently having a lower weight per foot of surface area coverage than real wood counterparts.

Moreover, in accordance with the present invention it has been found that relatively intricate and complex shapes and profiles can be molded in thin walled hardboard material to provide increased strength and resistance to wind uplift forces, drying out and curl up at corners of the panels, even though the panels weigh substantially less than real wood components and considerably less than substantially thicker, pressed fiber panels heretofore used, which panels often required much greater thicknesses in order to provide suitable stiffness and structural characteristics.

2. Description of the Prior Art

Various hardboard panels, panel siding and lap siding products of hardboard have been utilized for surfacing the exterior walls and roofs of buildings. In addition, lap siding and roofing products formed of aluminum and vinyl have been utilized and many of these products have attempted to replicate or simulate the appearance of historical or traditional siding and roofing materials made of wood.

A number of U.S. patents have been issued on roofing, panel siding, panels and lap siding products and are listed below as follows:

| | | | |
|---|---|---|---|
| Fink et al | RE. 24,246 | Turek | 3,897,667 |
| Montross | 373,373 | Gadsby | 3,899,855 |
| Ochs | 2,264,546 | Carothers | 3,943,677 |
| Brady | 3,333,384 | Allen et al | 4,366,197 |
| Kneisel | 3,326,493 | Eaton | 4,015,392 |
| Johnson | 3,643,394 | Geimer et al | 4,061,813 |
| Mattes | 3,703,795 | Kirkhuff | 4,065,899 |
| Wilson et al | 3,720,031 | Golder et al | 4,102,106 |
| Hanlon et al | 3,796,586 | Tellman | 4,188,762 |
| Wilson et al | 3,848,383 | Tellman | 4,261,152 |
| Eaton et al | 3,848,384 | Tellman | 4,266,382 |
| Kirkhuff | 3,852,934 | Gleason et al | 4,279,106 |
| Wheeler | 3,868,300 | Hanlon et al | 4,366,197 |

OBJECTS OF THE INVENTION

It is an important object of the present invention to provide a new and improved building panel formed of thin-walled, molded hardboard.

More particularly, it is an object of the present invention to provide a building panel of the character described having a deeply embossed or molded outer surface resembling a plurality of shingles or shakes aligned in a common course.

Still another object of the present invention is to provide a new and improved roofing panel having a deep drawn, molded outer shell formed of relatively thin hardboard with a transverse cross-sectional profile extending between the upper and lower edges of the panel having an overall depth measured between a back plane extending between a lower and upper edge portion of the panel and an outer surface that is considerably greater than the thickness of the shell material at any location thereon measured directly between the outer and inner faces thereof.

Yet another object of the present invention is to provide a new and improved building panel of the character described which is extremely light in weight, especially for the amount of surface area covered, and which closely resembles real wood cedar shingles or shakes as they are customarily applied to roofing or wall surfaces of a building.

Still another object of the present invention is to provide a new and improved building panel of the character described which is extremely economical to produce and which requires minimal labor to install because of greater facility in handling during installation and application, and because of the relatively large surface area covered by each panel.

Still another object of the present invention is to provide a new and improved building panel of the character described employing a plurality of shingle or shake-like elements having downturned edge portions along opposite sides and a downturned lower edge for providing extremely good resistance against wind uplift forces and curling forces generated at the corners normally caused by heating, cooling and repeated wetting and drying from prolonged exposure to weather.

Still another object of the present invention is to provide a new and improved thin-walled, molded hardboard building panel of the character described having a row of fastener receiving depressions formed therein adapted to facilitate the installation of the panels with fasteners which may be applied with automatic fastener guns and the like.

Yet another object of the present invention is to provide a new and improved building panel of the character described which is competitive from both an initial cost and a labor-saving standpoint in comparison to to conventional asphalt shingles and siding panels as well as other forms of hardboard, wood, vinyl and aluminum, siding and roofing products.

Yet another object of the present invention is to provide a new and improved building panel of the character described having extremely good structural characteristics for resisting uplift by wind forces and/or resisting cupping or curl at the corners and lower edge portions that are exposed to the weather.

Yet another object of the present invention is to provide a new and improved molded building panel of the character described having a relatively thin-wall, yet a relatively deep drawn, intricately shaped, molded outer surface which closely resembles a plurality of real wood shakes or shingles laid up in a common course or row.

Yet another object of the present invention is to provide a new and improved thin-walled, molded hardboard building panel of the character described which is designed to handle expansion and contraction resulting from moisture absorption and moisture loss without significant buckling, corner curl-up or other problems resulting from dimensional changes caused by prolonged exposure to weather.

Still another object of the present invention is to provide a new and improved building panel of the character described having a relatively intricate and complex profile and which can easily and rapidly be installed on a building wall or roof surface, even by an unskilled artisan, yet resulting in a wall surface having an outstanding appearance and excellent structural and overall performance characteristics.

Yet another object of the present invention is to provide a new and improved thin-wall, molded hardboard panel of the character described having minimum lap loss when laid up in overlapping courses on a building surface.

BRIEF SUMMARY OF THE INVENTION

The foregoing and other objects and advantages of the present invention are accomplished in a new and improved building panel for exterior and interior wall and roof surfaces comprising a shell formed of relatively thin, deep drawn, molded hardboard having upper and lower edges, opposite ends, and an intricately shaped, molded outer face adapted for exposure to the weather with a contoured back surface generally following the contour of the deep drawn outer face.

The shell has a cross-sectional profile taken transversely between the upper and lower edges of the panel comprising a lower edge portion which extends upwardly and outwardly of the lower panel edge from a back plane touching points on the back surface of the panel. The lower edge portion joins an intermediate panel facia portion spaced outwardly of the back plane and a row of fastener receiving depressions is formed along an upper edge of the intermediate facia portion, each depression including a recessed base spaced inwardly from an outer surface thereof and having a back face generally lying on the back plane of the panel.

The panel also includes an upper edge portion upwardly of the row of fastener receiving depressions which terminates along the upper edge of the panel and is adapted to lie beneath the lower edge portion and a segment of the intermediate facia portion of one or more panels laid up in a next higher overlapping row or course. The panels are defined with an overall thickness dimension between an outer face of the panel and the back plane that is substantially greater than the nominal wall thickness of the panel shell between the inner and outer surfaces thereof at any location thereon. Thus, the panel provides the appearance of thick butt shakes or shingles but is considerably lighter and utilizes much less material than real wood counterparts or relatively thick hardboard panels that are only embossed on the outer face.

BRIEF DESCRIPTION OF THE DRAWING

For a better understanding of the present invention reference should be had to the following detailed description taken in conjunction with the drawings, in which:

FIG. 8 is a fragmentary perspective view of a building roof structure with several panels applied thereon and another panel shown in elevated position ready for application;

FIG. 9 is a fragmentary cross-sectional view taken substantially along lines 9—9 of FIG. 8;

DESCRIPTION OF A PREFERRED EMBODIMENT

Figure 2:
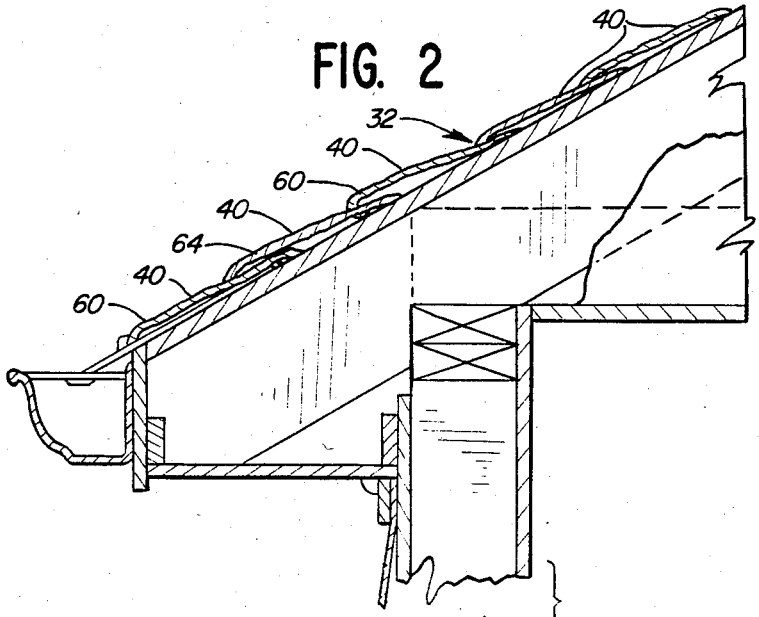
FIG. 2 is a vertical cross-sectional view taken substantially along lines 2—2 of FIG. 1.
Figure 1:
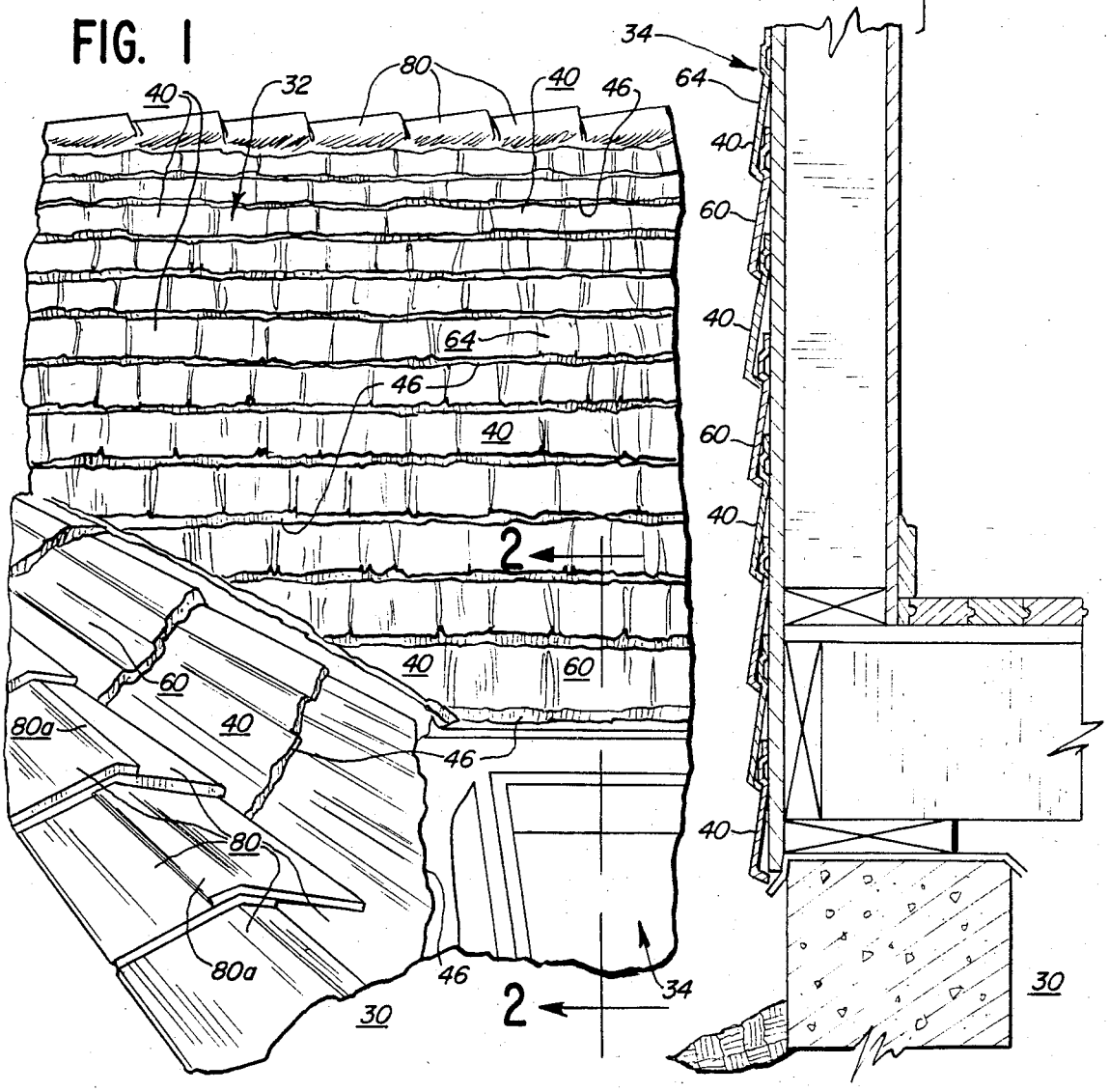
FIG. 1 is a fragmentary elevational view of a typical building structure utilizing building panels constructed in accordance with the present invention and laid up in parallel courses or rows in overlapping relation on a roof surface thereon.

Referring now more particularly to the drawings, in FIGS. 1 and 2 is illustrated a building 30 of a general or conventional type employing a sloped roof structure 32 and a vertical side wall 34. The roof and wall are covered with an outer or weather surface formed by a plurality of new and improved building panels 40 which are laid up in end-to-end relation in horizontal courses or rows. The panels in each succeeding higher course overlap an upper portion of the adjacent lower course or row as best shown in FIG. 2.

Each building panel 40 is formed of deep drawn, molded, thin walled, wood composite material such as hardboard of a substantially uniform thickness "t" and is of a generally rectangular shape as shown in FIGS. 3, 8, 14 and 15. The panels include a contoured back surface 42 generally following the variations in the outer face and bounded by an elongated upper edge or head 44 and a generally parallel, lower or butt edge 46 exposed to the weather. Each panel is formed with a deeply drawn, molded outer or weather face 60 designed to closely resemble a plurality of real wood, thick butt cedar shakes or shingles. The outer surface 60 includes elongated narrow strip or head lap portion 62 along the upper edge and the area of this strip comprises only a fractional or minor portion of the total or overall surface area of the whole building panel. The narrow head lap surface along the upper edge is adapted to underlie a narrow strip of back face along a lower portion of each succeeding panel or panels as the panels are laid up in place in a next adjacent upper row or course (as shown in FIGS. 8–9). When laid up in place as shown, the narrow overlapping or confronting portions of the panels form a substantially tight head lap between "S" (FIG. 9) successive courses or rows of panels on a wall or roof.

The outer weather face 60 of each panel includes a relatively large, lower surface or facia portion 64 lying below the narrow upper head lap 62 and delineated therefrom by a row of spaced apart fastener receiving depressions 66 parallel of and spaced intermediate the upper edge 44 and the lower, exposed butt edge 46 of the panel. The generally cup-shaped depressions 66 provide guidance for installing a single row of fasteners such as nails 45 for holding the panels in place on a building wall or roof surface. The panels 40 are provided with course alignment end marks or ribs 68, at each end, and these course alignment marks serve to align the ends and edges of panels in adjacent courses or rows as a roofing or siding job proceeds.

Figure 4:
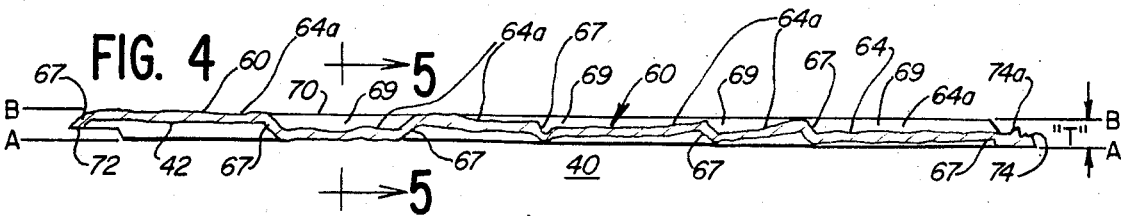
FIG. 4 is a longitudinally extending cross-sectional view of the panel of FIG. 3 taken substantially along lines 4—4 of FIG. 3.
Figure 5:
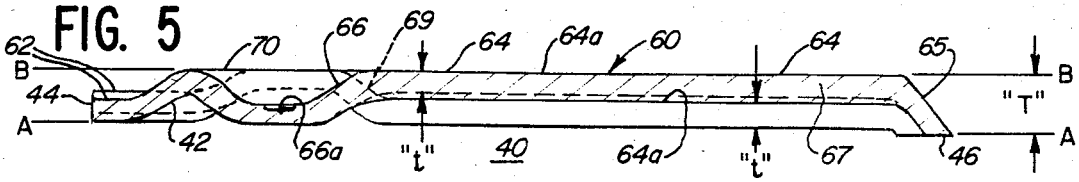
FIG. 5 is a cross-sectional view taken substantially along lines 5—5 of FIG. 4.

In accordance with the present invention, the weather exposed, outer facia portion 64 of the outer surface 60 is formed by a deep draw, molding process to resemble closely in appearance, a plurality of individual shakes or shingle-like elements 64*a*. Each element is outwardly convex or inwardly concave to provide a shallow, inverted, generally cup-shaped configuration which is stiff and strong even though the wall thickness is relatively small. Referring now specifically to FIGS. 4, 5 and 9, each individual shingle or shake-like element 64*a* is formed with a shallow, inverted cup-shaped configuration in the deep draw, molding process as each element includes a thick butt, lower edge portion 65 comprising a segment of the overall longitudinal lower edge 46 of the panel. The lower edge portions slope upwardly and outwardly from a lower edge or apex 46*a* which touches on a back plane "A—A" defined to extend between the lower edge 46*a* and the underside or apex 44*a* of the upper panel edge 44 as shown in FIG. 5. The upwardly and outwardly sloping lower edge portions 65 of each individual shingle-like or shake element blend and join with the outer facia portions 64*a* and a plurality of these facia portions make up the overall weather surface 64 of the panel. Each shingle or shake-like element 64*a* also includes at least one upwardly and outwardly or downwardly sloping side edge portion(s) 67, which portion(s) in cooperation with the lower edge portion 65 provides stiffening and strength to resist wind uplift forces and to resist any corner curl up tendencies caused by the repeated absorption and elimination of moisture in the hardboard material over periods of prolonged exposure to the weather.

Figure 7:
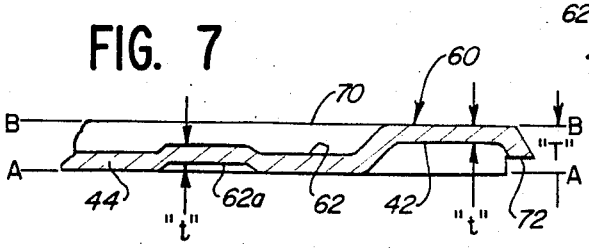
FIG. 7 is a fragmentary upper edge elevational view of the panel looking in the direction of arrow 77 of FIG. 6.
Figure 6:
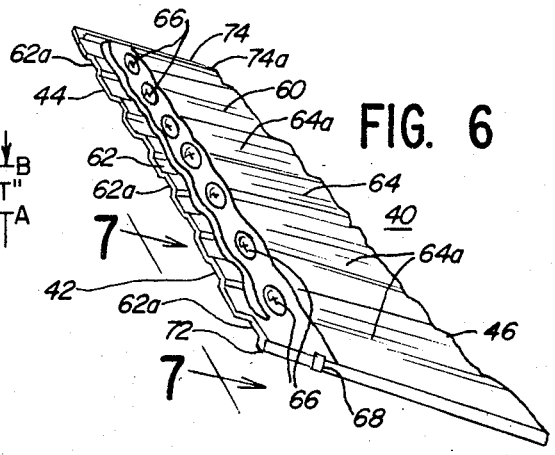
FIG. 6 is a perspective view of the panel of FIG. 3 looking downwardly in a direction along the upper edge and outer surface of the panel.
Figure 10:
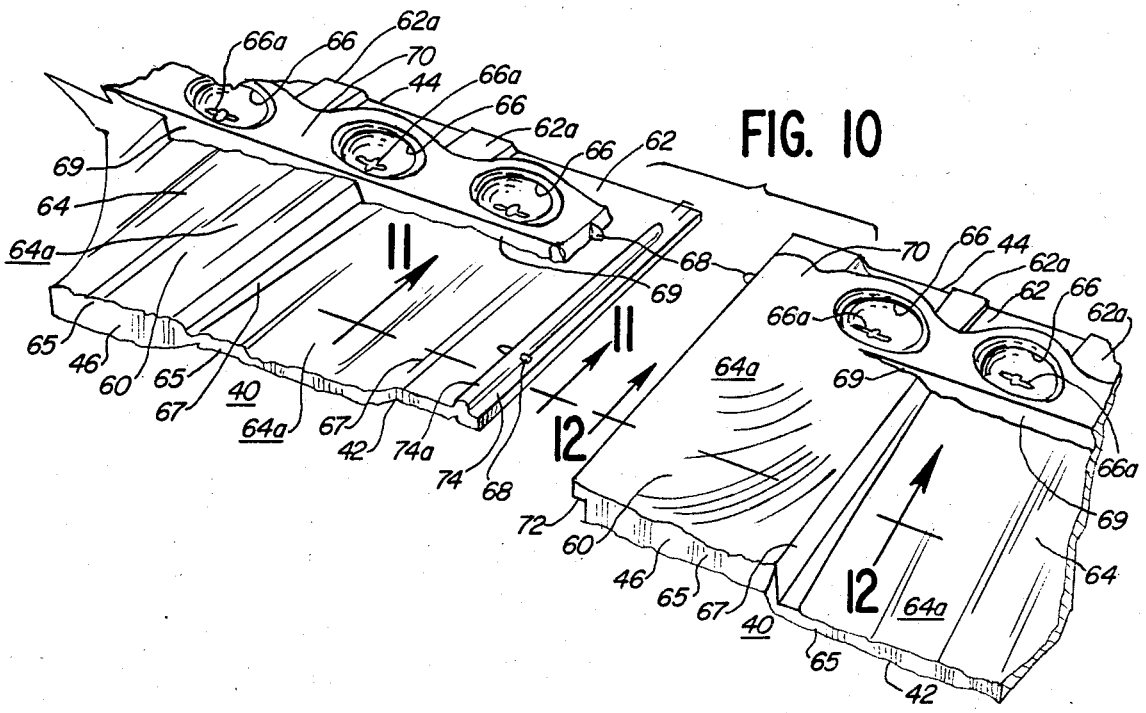
FIG. 10 is a fragmentary perspective view of a pair of panels in accordance with the present invention shown in juxtaposition prior to installation of the panels in a single course or row along a roof surface of a building.
Figure 11:
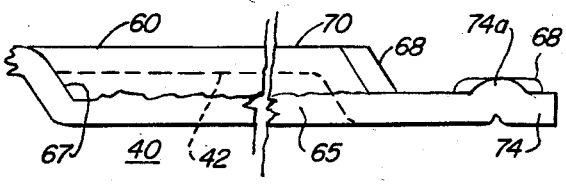
FIG. 11 is a transverse fragmentary cross-sectional view taken substantially along lines 11—11 of FIG. 10.
Figure 12:
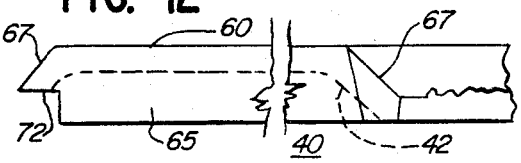
FIG. 12 is a similar transverse cross-sectional view taken substantially along lines 12—12 of FIG. 10.
Figure 13:
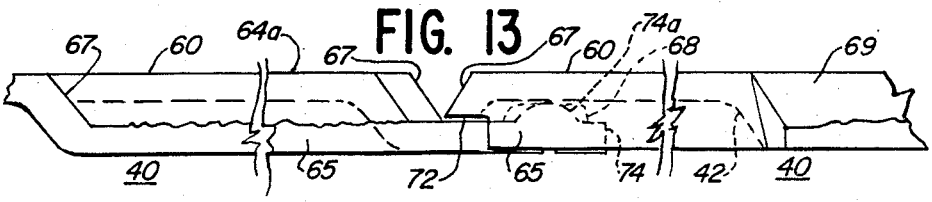
FIG. 13 is a transverse cross-sectional view taken substantially along lines 11—11 and 12—12 of the panels of FIG. 10 but after the panels have been installed in overlapping relationship.
Figure 14:
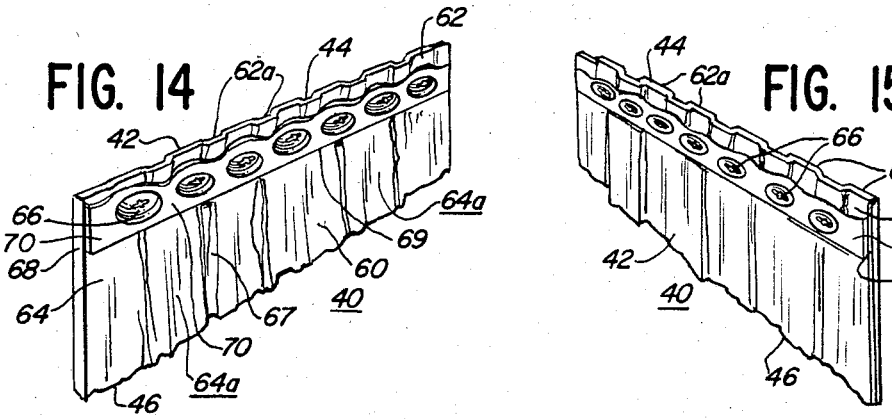
FIGS. 14 and 15 illustrate a pair of panels in accordance with the present invention in angularly disposed relation to one another prior to stacking together in a bundle.
Figure 15:
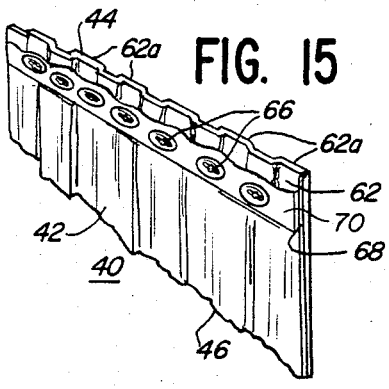
Figure 16:
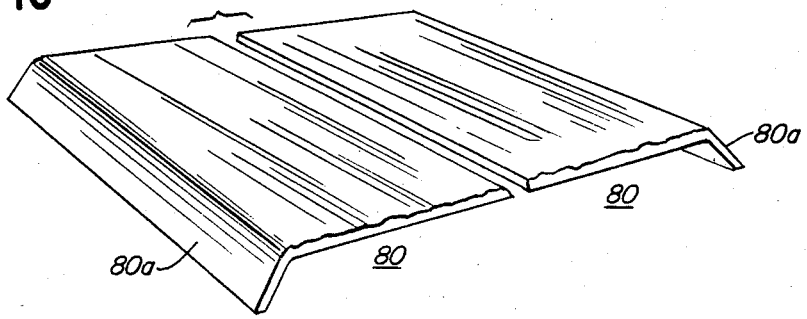
FIG. 16 is a perspective view of a pair of accessory panels in accordance with the present invention utilized along a gable end of a roof structure.

In accordance with a feature of the present invention, the panels 40 are dimensioned with an overall thickness "T" (FIGS. 4, 5, and 7) measured between the back plane "A—A" and an outer or front plane "B—B" which is coextensive with outermost surface portions of at least one shingle-like element(s) 64*a* and a planar, fastener receiving strip 70, which strip runs longitudinally of the panel intermediate the upper and lower edges and surrounds the longitudinally spaced, fastener receiving, cup-shaped depressions 66. This overall thickness dimension "T" is substantially greater than the relatively thin wall thickness "t" measured directly between the outer face 60 and the back face 42 of the panel at any point or location on the surface thereof. This substantial difference between the overall panel thickness "T" and the shell or wall thickness "t" of the hardboard material is made possible by the deep draw, molding process used to form the intricately shaped outer surface 60 of the panel with the shallow, inverted cup-shaped design of the individual shingle-like elements 64*a*. These elements make up the main facia area of the panel extending between the intermediate, planar fastener strip 70 and the lower panel edge 44 comprising about 80%–90% of the overall or total surface area of the panel.

Each shingle-like element 64*a* integrally joins a lower edge portion of the planar face of the fastener strip 70 (containing the fastener receiving depressions 66) with an upwardly and outwardly sloping upper edge segment 69, thus resulting in an extremely strong panel construction even though the actual amount of material present is relatively low due to the fact that the wall thickness "t" is considerably less than the general or overall thickness "T" of the panel as whole measured between the back plane "A—A" and front plane "B—B".

For example, in a commercial embodiment of the present invention the overall panel dimensions may be approximately 12 inches high by 48 inches wide in order to span three, 16 inch on center studs, rafters or other supports. The thin wall "t" of the hardboard material making up the panel shell is approximately $\frac{1}{8}$" in thickness and the overall thickness of the panels as a whole as measured by the dimension "T" between the back plane "A—A" and front or outer plane "B—B" may be as high as $\frac{3}{4}$" to 1". This arrangement provides exceptional stiffness and resistance against wind uplift forces even though the amount of material required to make a panel is substantially less than that of a nominal 7/16" or $\frac{1}{2}$" thick hardboard panels of the type typically used for siding and roofing panels.

The outer face plane "B—B" is coextensive with portions of the planar outer surface of the elongated fastener strip 70 in which the nailing or fastener receiving depression 66 are formed, and these depressions are generally shallow and cup-shaped, having a circular or oval outline. Each depression includes a flat, generally circular, base having an underside that is coextensive with the back plane "A—A" of the building panel. The upper surface of the base is formed with a cross or other marker indentation 66*a* to guide a workman in positioning a nail or other fastener which may be driven from an automatic tool or fastener gun used for securing the panels in place on a building wall or roof structure. The cup-shaped depressions 66 are large enough to accommodate the entire nose or drive track of an automatic fastener driving tool and the depressions serve to generally guide the positioning or placement of the drive track of the tool on the panel so that the panels 40 can be installed in a rapid fashion with the correct number and placement of fasteners on the panel.

The narrow head lap or upper edge portion 62 of the panel is generally at a level lower than the fastener strip face 70 and has an underside, generally coextensive with the back plane "A—A" as best illustrated in FIG. 5. In order to permit the drainage of any moisture condensing or collecting above an upper edge 44 of the panel in the space beneath the facia or raised portion of the panels in a next higher course, the upper edge portion 62 of the panel is formed with a plurality of slightly elevated or raised, air and water drain passages 62*a* (FIGS. 3, 6, 7 and 10) and these passages permit air circulation between upper and lower portions of the panels behind the back surface.

In accordance with the present invention, the upper surface of the fastener strip 70 along a portion between the lower edge of the row of the fastening receiving depressions 66 and above the upper edges 69 of the individual shake-like elements 64*a* is adapted to provide a flat bearing surface "S" for contact with the lower edges 46 of panels 40 which are laid up in overlapping relation in a next higher course or row as best shown in FIGS. 8 and 9. This relatively tight overlapping arrangement between the lower edges 46*a* of the upper panels and the planar upper face of the strip 70 on lower panels generally retards or stops the flow of wind driven water from passing upwardly along the overlap area between successive panel courses.

From the foregoing it will be seen that the deep drawn, molded panels 40 in accordance with the present invention have only a relatively small thickness "t" of hardboard material yet provide a profile as shown in FIG. 5 that is strong and stiff. Because of this strength, only a single row of nails or fasteners placed at spaced intervals in the depressions 66 along the strip 70 is used to hold the panels in place. Moreover, the fasteners are eventually covered by overlapping panels in the next course. In the overlapping arrangement of successive panel courses, the lower edges 65 of the individual shake-like elements 64*a* rest on the lower portion of the planar fastener strip 70 in the next lower course of panels, and the panels are relatively free to expand and contract without buckling or cracking. A single row of nails or fasteners are used in each panel at appropriate intervals specified by the location of the fastener receiving depressions 66 and the upper and lower edges of the panels are not restrained by nailing or other fasteners. The deep drawn, molded design of the panels and the resulting overall panel thickness "T" substantially greater than the nominal wall thickness "t" of material provides an aesthetic appearance that closely replicates or resembles more expensive and heavier, thick butt cedar shake or shingles, but at a fraction of the cost, less lap loss and at a smaller fraction of time required to install a surface covering on a given surface area of a roof or wall structure.

In comparison to real wood shakes or shingles, the panels 40 are much easier to put in place, align and install because a single panel covers a surface area that requires a considerably larger number (5 or 6) of individual, real wood shingles or shakes. The panels 40 have a minimum of overlap in comparison to real wood shakes or shingles and overall, cover a given surface area on a building with a fraction of the weight, at a much lower cost, and a minimum of application time being required for installation the in comparison to real wood shakes. The thin molded hardboard roofing and siding panels 40 of the present invention thus provide the best of both worlds.

Figure 3:
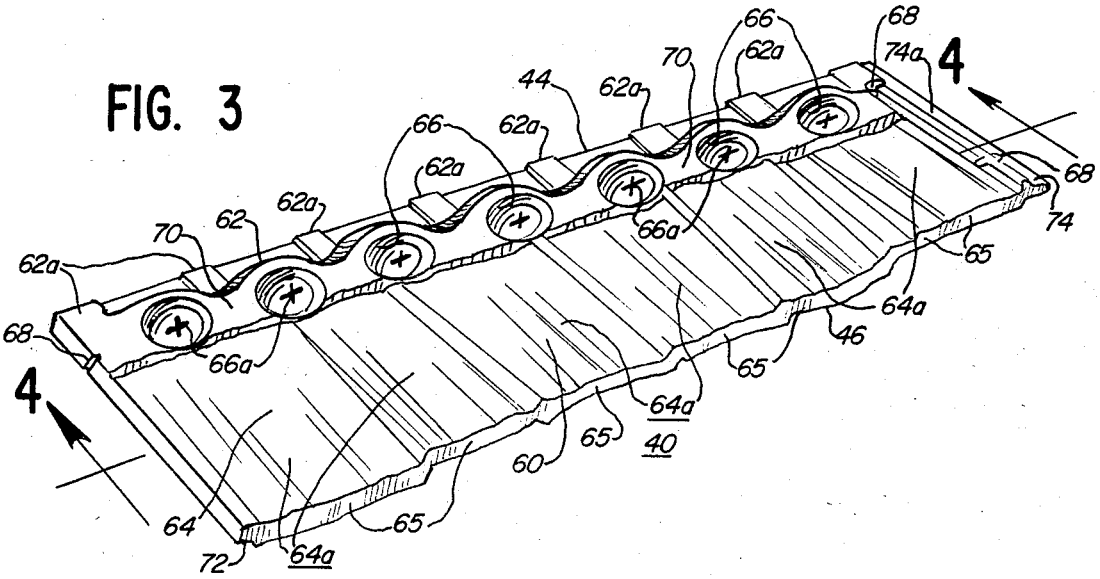
FIG. 3 is a perspective view of an embodiment of a new and improved building panel constructed of thin-walled, molded hardboard in accordance with the features of the present invention and showing an outer face and a lower butt edge thereof.

In accordance with the present invention, the panels 40 are laid end to end in each course or row with left hand end portions 72 of the panels adapted to overlie, right hand end portions 74 of adjacent panels to form a ship-lap, end to end joint. As best shown in FIGS. 10–13, the overlying left hand end portion 72 of a panel is adapted to cover over a narrow portion of an underlying right hand end portion 74 of an adjacent panel. The right hand end portions of the panels are formed with an upwardly projecting stiffening rib 74*a* adapted to provide a positive interlock for ensuring that the overlying end portions 72 and 74 do not become inadvertently disengaged. As illustrated in FIG. 3, the spacing between the rib 74*a* and the adjacent edge portion of the shake or shingle like element 64*a* is sufficient to permit the downwardly sloping left hand edge 67 of the overlapping panel segment 72 to float or move without becoming disengaged from the overlying, ship-lap joint arrangement. This unique construction permits the exposed lower portions of the panels encompassing the facia surface area 64 to expand and contract without buckling or restraint in a longitudinal direction or in a transverse direction. Because the underlying right hand end segments 74 are relatively thin, the upstanding rib 74*a* tends to provide an added stiffness to the structure and prevents inadvertent breakage during storage, transportation, handling and application. Such damage might result if a thin flat edge portion was constructed without such a stiffening rib therein.

Figure 17:
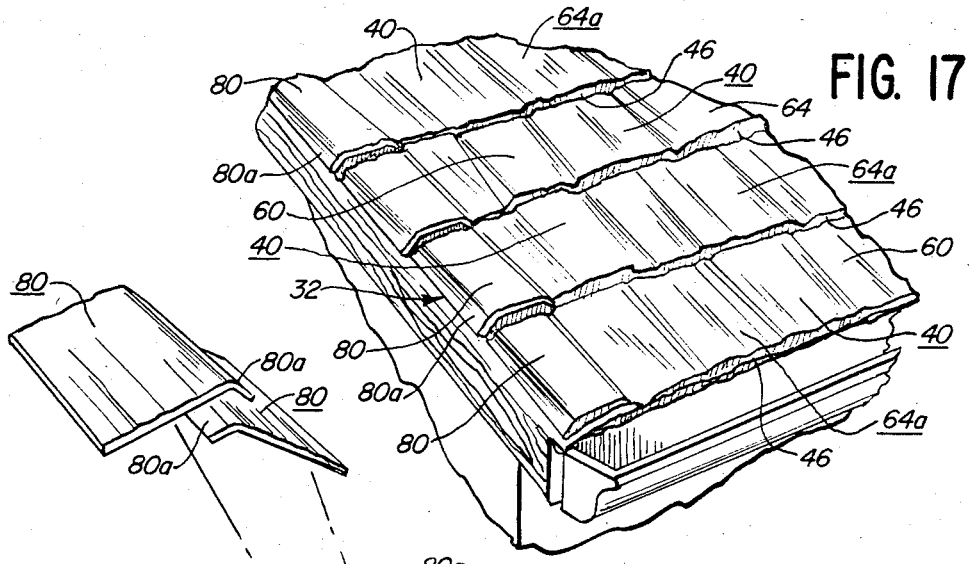
FIG. 17 is a fragmentary perspective view of a roof structure with gable end accessory panels as shown in FIG. 16 installed in place along the gable end.
Figure 18:
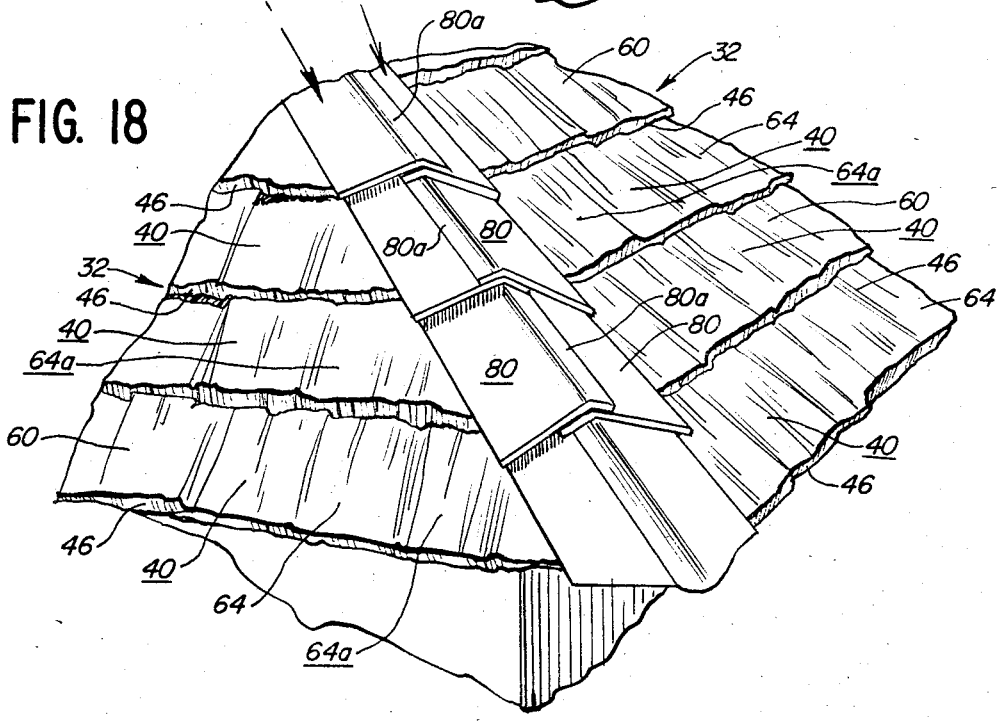
FIG. 18 is a fragmentary cross-sectional view of a hip portion of a roof structure illustrating a roll of accessory panels of the type shown in FIG. 16 as utilized for application along the hip of the roof structure.

Referring now to FIGS. 1 and 16–18, pairs of accessory panels 80 are provided for hips and ridges of a roof structure and the end of a gable as shown in FIG. 17. For this purpose, accessory panels 80 are formed of thin-wall, molded hardboard material like the basic panels 40. The accessory panels are provided with a downturned edge portion 80*a* along one edge to provide an overlapping cover for a hip ridge or gable end line as the case may be. The angular deviation of the relatively narrow edge portion 80*a* and the basic body of the accessory panels 80 is chosen so as to accommodate a general range of pitch angles that are commonly encountered on hip and ridge roof structures and it has been found that an angle of approximately 45° works well on gable ends as shown in FIG. 17. Accessory panels 80 include an outer face which is molded to closely resemble the surface of cedar shakes or shingle-like elements similar to the elements 64*a* of the basic panels 40 and the accessory panels are adapted to overlie respective shingle-like elements 64*a* at the end of a basic panel 40 so as to function as a cover over a gap or edge opening between the panel end and adjacent supporting structure to shield and cover the gap which would otherwise be present along a ridge, hip, or gable end line of a roof.

The unique, thin wall, molded hardboard panels 40 are free to move or float in both vertical and horizontal directions between upper and lower edges and between opposite ends, respectively, after installation and are extremely strong, even though light in weight and even though the panels require much lower quantity of wood hardboard material than conventional hardboard panels, panel siding and lap siding heretofore available for the same functional application.

When laid up as described, the panels 40 allow air and moisture venting to occur and the unique design of the panels permits contraction and expansion of the panels in both directions in response to absorption and desorption of moisture as weather conditions change.

The panels 40 are fabricated in a hardboard manufacturing press employing a multiplicity of press plates arranged in pairs and contoured to provide the intricate molded shape of the panel profile. U.S. Pat. No. 1,923,548 illustrates a multiple plate press capable of manufacturing a number of panel blanks in a single pressing operation. Each press cavity comprises an upper plate having an underside or surface which is shaped to replicate the molded intricate design of the outer face 60 of a plurality of panels. Customarily the press plates are dimensioned to form panel blanks that are 4' wide by 16' in length and accordingly, a total of 16 panels of a 12"×48" size can be made in a single pressing between each pair of press plates in the press. A large press may have a total of 20 pairs of press plates so that 20 panel blanks may be formed at each pressing.

Preferably, the molded hardboard panel blanks are produced in a dry process and the press plates are fabricated in an electroforming process generally as follows. As a first step, a real wood model or prototype of the desired panel upper surface shape is made up using wood elements. This is done by placing a plurality of real wood shingles and/or shakes onto a supporting flat base in a desired pattern or arrangement. The exact surface pattern that is desired to be duplicated in hardboard material is fashioned in a wood model or basic prototype, and attention to detail in every aspect is the key note. After the desired panel surface is completed in a wood prototype, a negative is made therefrom by casting resinous plastic material over the desired surface of the prototype. When the plastic material is hardened, an exact negative duplicate of the desired surface shape is available. This plastic negative is then used as a master negative mold for making as many positives as may be needed, and these positives are also formed of cast resinous plastic material. After a positive is completed, it is secured by adhesive onto a steel backer plate and the surface of the positive is coated with electroconductive, silver material. The silvered positive on its backer plate is then submersed into an electrolytic bath and an electrolytic process is begun so that electro-deposition of nickle onto the silver surface of the positive begins to take place. When the thickness of nickle deposit is sufficient to function as a wall for the mold or press plate, the backer plate and positive are for the removed from the electrolysis tank and the built up nickle material is machined to be flat or planar in precise parallelism with the surface of the backer plate. After this machining is accomplished, the electro-deposited mold is separated from the positive and backer plate and is secured in place on another backer plate with the machined face held tightly against the planar surface of the plate. This new backer plate and mold are then mounted on a steam chamber in the press to function as an upper press plate of a pair of mold plates.

The back or lower plate in each pair of press plates is contoured to only generally follow the intricate surface shape of the upper plate and does not precisely follow the small variations in the surface pattern of the upper plate. In order to form a lower press plate, another negative plastic replica of the wood prototype pattern is utilized. This negative functions as a vacuum mold and is provided with a plurality of spaced apart, small diameter, drilled vacuum openings in the wall. A thin sheet of styrene material approximately 1/10th of an inch thick is drawn in closely against the surface of the negative mold by drawing a vacuum through the small drilled holes and this results in a styrene surface formed to generally follow but not precisely matching that of the negative. A backer plate positive is then cast against the surface of the vacuum drawn styrene sheet and this positive is coated with electro-conductive silver material as before described and secured to a backer plate for the electrolytic process. When the mold wall thickness is sufficient, the electrolytic process is discontinued and the parallel machining operation is accomplished in a manner similar to that used in making an upper press plate.

Each press plate is mounted on a heated plenum chamber approximately 4 inches in thickness and the chamber is filled with super heated steam at 550 psi. Hardboard material in mat form several inches thick is introduced into the cavity or space between each pair of spread apart or opened, upper and lower plates. The composite wood material used to make hardboard in a dry process is composed of wood chips which are further exploded and broken down into individual wood fibers. These fibers are heated and mixed with phenolic resins and sized with a petroleum based, moisture retarding agent such as petrolatum. The material is then deposited onto a moving support in the form of a thick, fluffy mat or continuous web of material which is subsequently introduced into the spaces between open pairs of press plates in the press.

After introduction of the mat into all of the cavities in the press, the press plates are closed and moved toward one another in a pressing operation to compress the fibrous mat into a thin, molded hardboard shell having the desired pattern and profile of the mold plate surface. Normally, the time period during a pressing operation while the press plates are closed may vary from between one minute and two minutes and the temperature of the wood material of the mat being compressed is raised during the pressing cycle to approximately 430° F. by the direct contact with the press plates which are heated by the super heated steam at 550 psi. After the pressing cycle is completed, the press plates are opened or spread apart and the finished molded hardboard blanks each containing a plurality of the panels 40 are removed from the press.

The surfaces of the respective upper and lower press plates in each pair of press plates are dimensioned so that the nominal thickness of the of the thin, molded hardboard profile being produced is approximately $\frac{1}{8}$". The press plate surfaces are designed so that a relatively large amount of relief or draw (from $\frac{1}{2}$" or $\frac{3}{4}$") may be provided in the panel when the plated are fully closed. This results in panels 40 that appear to be much thicker ("T") than the actual wall section thickness "t" of the hardboard material itself.

Panels 40 of the present invention may weigh an average of 98 to 100 pounds per square (100 square feet) of surface area covered, whereas a typical asphalt or laminated asphalt shingle may weigh from 240 pounds up to 320 pounds per square. Conventional hardboard panels and roofing elements that are nominally 7/16" or $\frac{1}{2}$" in thickness may weigh as much as 250 pounds per square and real wood, thick butt cedar shakes and shingles may weigh considerably more than this value, because of the high percentage of overlap and the extra thickness and volume of material present.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. A building panel for ecterior and interior wall and roof surfaces, comprising:

an outer shell formed entirely of relatively thin, molded hardboard material, having upper and lower edges and opposite ends, and a molded, outwardly convex outer face adapted for exposure to weather and a molded back surface contoured to generally follow the contour of the surface of said outer face;

said shell having cross-sectional profile extending transversely between said upper and lower edges of said panel comprising a sloped lower edge portion extending outwardly of said lower edge and sloped upwardly toward said upper edge from a back plane of said panel defined to extend directly between said upper and lower edges, said sloped lower edge portion joining an intermediate facia portion spaced apart outwardly of said back plane, a plurality of spaced apart fastener receiving depressions aligned in a row extending between said opposite ends of said panel adjacent an upper edge of said intermediate facia portion, said depressions having a base spaced inwardly thereof with a back face of said depression bases on said back plane, and an upper edge portion above and adjacent said row of fastener receiving depression and terminating along said upper edge of said panel, said shell having a depth dimension between said outer face on said intermediate facia portion and said back plane that is substantially greater than the nominal thickness of said shell as measured directly between said outer face and said back at any point thereon.

2. The building panel of claim 1 wherein:

said intermediate facia portion of said outer face comprises a plurality of shingle-like elements spaced side by side longitudinally of said panel and molded to resemble shingles/shakes laid up in a common course, each of said elements having a lower edge comprising a portion of said sloped lower edge portion of said panel and at least one side edge between adjacent elements between said sloped lower edge portion and an upper edge of said intermediate facia portion extending outwardly between said outer face and said back plane.

3. The builiding panel of claim 2 wherein:

said shingle like elements are joined along said upper edge of said intermediate facia portion by an elongated, integral fastener receiving strip having a generally planar outer face, and said plurality of said fastener receiving depressions in said row and positioned at longitudinally spaced intervals adjacent said strip which extends between said opposite ends of said panel.

4. The builiding panel of claim 3 wherein said fastener receiving depressions are generally cup-shaped including an outwardly projecting wall around said depression base for guiding the installation of a row of fasteners, said row extending intermediate said upper and lower edges of said panel.

5. The building panel of claim 3 wherein said fastener receiving depressions are provided with marking means on an outwardly facing surface of said bases for aiding the installation of said row of fasteners.

6. The building panel of claim 3 wherein, said planar outer face of said strip is spaced outwardly of said back plane and adapted to abut a lower edge of another panel laid up in overlapping relation in an adjacent upper course.

7. The building panel of claim 2 wherein said shingle-like elements are of a shallow, inverted, generally cup-shaped configuration joining one another along an adjacent side edge.

8. The building panel of claim 7 wherein at least one of said shingle-like elements is generally outwardly convex in shape for resisting wind uplift forces.

9. The building panel of claim 7 wherein at least one of said shingle-like elements is generally inwardly concave in shape for resisting wind uplift forces.

10. The building panel of claim 3 wherein said panel includes an upper edge portion joining said fastener receiving strip, spaced inwardly thereof and forming said upper edge of said panel.

11. The building panel of claim 10 wherein said upper edge portion includes a back surface closely adjacent said back plane and at least one vent passage formed to communicate between said upper edge of said panel and a space behind said fastener strip.

12. The building panel of claim 11 wherein said vent passage comprises a segment of said upper edge portion spaced above said back plane.

13. The panel of claim 12 including a plurality of said vent passages at longitudinally spaced intervals along said upper edge of said panel.

14. The panel of claim 3 wherein at least one of said shingle-like elements includes an upwardly and outwardly extending upper edge portion joining a lower edge of said elongate fastener strip.

15. A building panel for exterior and interior wall and roof surfaces, comprising:

an outer shell formed entirely of relatively thin, molded hardboard material, having upper and lower edges and opposite ends, and a molded outer face adapted for exposure to weather and a molded back surface shaped to generally conform to the surface shape of said outer face;

said panel including an upper edge portion along said upper edge integrally joining an elongated fastener receiving strip of inverted generally channel-shaped transverse cross-section formed intermediate said upper and lower edges of said panel and running parallel thereof;

an intermediate facia portion integrally joining said fastener receiving strip and a lower edge portion of said panel integrally joining said intermediate facia portion;

said intermediate facia portion comprising a plurality of individual, outwardly convex, shingle-like surface elements spaced side by side between said opposite ends of said panel and having outer surfaces molded to replicate a plurality of shingles/-shakes laid up in a common course;

said outer surface portions of at least some of said surface elements spaced outwardly apart from a back plane defined to extend between said lower edge portion and upper edge portion of said panel.

16. The panel of claim 15 wherein said fastener receiving strip includes a plurality of fastener receiving depressions formed in a row at spaced apart intervals longitudinally between said opposite ends.

17. The panel of claim 15 wherein said fastener receiving depressions are of a shallow cup shaped configuration for guiding the installation of a row securing said panel to a building structure along a line spaced between said upper and lower edges of said panel.

18. The panel of claim 15 including ship-lap end portions defined at said opposite panel ends, a first end portion of said panel designed and adapted to overlay a second opposite end portion of an adjacent panel laid up, when said panels in end to end relation in a common course.

19. The panel of claim 18 wherein said second opposite end portion of said panel is provided with an outwardly projecting stiffening rib spaced inwardly of and parallel of an adjacent panel end.

20. The panel of claim 15 wherein said panel includes end and edge alignment marks for guiding installation of said panels on a building surface in end to end, and course to course overlapping relation.

* * * * *

UNITED STATES PATENT AND TRADEMARK OFFICE

CERTIFICATE OF CORRECTION

PATENT NO. : 4,592,185

DATED : June 3, 1986

INVENTOR(S) : Steven K. Lynch, et al

It is certified that error appears in the above-identified patent and that said Letters Patent are hereby corrected as shown below:

Col. 10, line 67, "ecterior" should read -- exterior --.

Signed and Sealed this

*Thirtieth* Day of *September 1986*

[SEAL]

*Attest:*

DONALD J. QUIGG

*Attesting Officer*

*Commissioner of Patents and Trademarks*